US009560904B2

(12) United States Patent
Jollet

(10) Patent No.: US 9,560,904 B2
(45) Date of Patent: Feb. 7, 2017

(54) APPLICATOR HAVING A TWISTED CORE THAT GIVES OFF HEAT

(75) Inventor: Frédéric Jollet, Cressonsacq (FR)

(73) Assignee: L'OREAL, Paris (FR)

( * ) Notice: Subject to any disclaimer, the term of this patent is extended or adjusted under 35 U.S.C. 154(b) by 959 days.

(21) Appl. No.: 13/378,683

(22) PCT Filed: Jun. 18, 2010

(86) PCT No.: PCT/IB2010/052769

§ 371 (c)(1),
(2), (4) Date: Feb. 13, 2012

(87) PCT Pub. No.: WO2010/150162

PCT Pub. Date: Dec. 29, 2010

(65) Prior Publication Data

US 2012/0148328 A1 Jun. 14, 2012

Related U.S. Application Data

(60) Provisional application No. 61/231,121, filed on Aug. 4, 2009.

(30) Foreign Application Priority Data

Jun. 23, 2009 (FR) ..... 09 54248

(51) Int. Cl.

| | |
|---|---|
| ***A46B 11/08*** | (2006.01) |
| ***A45D 2/48*** | (2006.01) |
| ***A45D 40/26*** | (2006.01) |
| ***A46B 9/02*** | (2006.01) |

(52) U.S. Cl.

CPC ..... *A45D 2/48* (2013.01); *A45D 40/265* (2013.01); *A46B 9/021* (2013.01); *A46B 11/08* (2013.01); *A45D 2200/155* (2013.01); *A45D 2200/207* (2013.01); *A46B 2200/1053* (2013.01)

(58) Field of Classification Search

USPC ..... 401/1–2

See application file for complete search history.

(56) References Cited

U.S. PATENT DOCUMENTS

| | | | | |
|---|---|---|---|---|
| 2005/0031400 | A1* | 2/2005 | Marcotte et al. | 401/1 |
| 2007/0286666 | A1* | 12/2007 | Bouix et al. | 401/2 |
| 2008/0083421 | A1 | 4/2008 | Malvar et al. | |

FOREIGN PATENT DOCUMENTS

| | | |
|---|---|---|
| EP | 0611170 | 8/1994 |
| EP | 1468628 A1 | 10/2004 |
| EP | 1649777 | 4/2006 |

(Continued)

OTHER PUBLICATIONS

International Search Report dated Jul. 30, 2010.

*Primary Examiner* — Mark A Laurenzi
*Assistant Examiner* — Bradley Oliver
(74) *Attorney, Agent, or Firm* — Pearne & Gordon LLP

(57) ABSTRACT

The present application relates to a device (1) comprising an applicator (3) including a brush (5), said brush comprising:

- a core (10) that is formed of at least two branches of a resistor wire that are twisted together;
- bristles that are carried by the core (10); and
- a power supply that is connected to the branches in such a manner that the core (10) gives off heat while an electric current is passing therethrough.

15 Claims, 5 Drawing Sheets

(56) References Cited

FOREIGN PATENT DOCUMENTS

| | | | |
|---|---|---|---|
| EP | 1652449 | | 5/2006 |
| EP | 1836924 | | 9/2007 |
| EP | 1977662 | | 10/2008 |
| FR | 2853504 | A1 | 4/2003 |
| FR | 2913319 | A1 | 3/2007 |
| FR | 2916328 | | 11/2008 |
| WO | 99/22782 | A2 | 5/1999 |
| WO | WO2007125206 | | 11/2007 |
| WO | WO2007125207 | | 11/2007 |

* cited by examiner

APPLICATOR HAVING A TWISTED CORE THAT GIVES OFF HEAT

The present invention provides a device for applying a cosmetic composition to macroscopic human keratinous fibers and/or for combing said fibers, the device including an applicator having a brush that gives off heat.

It is known to use an applicator including a heater member after the composition has been applied to the eyelashes by means of a conventional comb or brush, so as to add the finishing touches to makeup applied to the eyelashes, in particular so as to extend or to curl the eyelashes.

It is also known to use an applicator provided with a heater member for applying the composition. In this situation, the composition is deposited in solid form in contact with the heater member, the heater member being raised to a temperature that is sufficient to cause it to melt.

It is also known to use a heating applicator to change the rheology of the applied composition.

Patent FR 2 853 504 teaches using as applicator means for applying the composition, a heater resistor that is configured in the form of a coil having a plurality of turns, or, in a variant, bristles that are configured in the form of a coil of turns that are interleaved, at least in part, in the turns of the coil formed by the heater resistor.

In FR 2 853 504, the bristles are not carried by the heater resistor and said heater resistor has an helical shape but not a twisted shape.

International application WO 99/22782 teaches making the core of a heater applicator with a heater wire, and fastening applicator elements to the heater wire.

WO 99/22782 does not disclose a twisted core made of heating wire, with applicator elements trapped between the branches of the core.

Application FR 2 913 319 discloses a cosmetic applicator that includes a heater member disposed in the applicator head in the vicinity of teeth.

There exists a need to improve still further devices for applying a cosmetic composition to human keratinous fibers and/or for combing said fibers, the devices including a heater member.

An object of the invention is to satisfy this need. Exemplary embodiments of the invention provide a device comprising an applicator including a brush, said brush comprising:

- a core that is formed of at least two branches of a resistor wire that are twisted together;
- bristles that are carried by the core; and
- a power supply that is connected to the branches in such a manner that the core gives off heat while an electric current is passing therethrough.

The twisted core of the brush may act both as support for the bristles and as heater member, thereby making it possible, for example, to avoid having to use two distinct coils of turns to perform those two functions, as in patent FR 2 853 504. This also makes it possible to simplify fabrication of the applicator, and to avoid not adding to the bulkiness of the applicator.

By way of example, the position of the bristles on the brush results from the twisting force applied to the branches of the core.

The bristles may be carried directly or indirectly by the core. The bristles may be trapped between the branches of the core without any additional fastening step. The bristles may be held solely by the branches of resistor wire, unlike in FR 2 853 504.

The core may be constituted by the twisted branches of the resistor wire.

By way of example, the power supply comprises an independent electrical energy source, e.g. one or more optionally-rechargeable batteries.

The applicator may include a stem that is connected at a first end to the twisted core, and two electrical conductors that pass through the stem and that are respectively connected to the two branches of the core.

The applicator may include two electrical connectors for connecting to the core of the brush. By way of example, the stem is overmolded on the connectors.

The surface of the resistor wire may be electrical insulation. In a variant, the surface of the resistor wire need not be covered in electrical insulation, e.g. the bristles may provide the electrical insulation between the branches, and the core need not have a twisted portion that does not carry any bristles.

The core of the brush may be twisted with a left-hand pitch or with a right-hand pitch.

The core of the brush may be different from a helical coil.

By way of example, the resistor wire may be folded into a U-shape, and each free end of a branch of the core may be inserted into one of the above-mentioned electrical connectors. In a variant, the two branches of the core may be constituted by two distinct wires. The core may thus be powered by its opposite ends, with each end of the core being inserted into one of the above-mentioned electrical connectors, for example.

By way of example, the resistor wire may be selected from wires made out of: non-magnetic nickel and chromium alloy, in particular Nichrome®; copper and nickel alloy, in particular Constantan®; or iron-nickel-aluminum or iron-chromium-aluminum alloy.

The device may include a container containing the cosmetic composition for application, and the applicator may be configured so as to be fastened on the container when not in use.

At least one bristle of the brush may be made out of a material that changes color with temperature, and that may constitute a visual indicator enabling the user to determine whether or not the temperature for applying the composition has been reached.

The applicator may include a handle, and the independent electrical energy source may advantageously be housed in the handle.

By way of example, the operating temperature of the brush may lie in the range 25° C. to 125° C. The temperature may be measured with an infrared thermometer without contacting the surface of the core, in a 20° C. environment, while the brush is not loaded with any composition. By way of example, the heating provided by the brush makes it possible to fluidify waxes or other compounds present in the composition, so as to make them easier to apply. The composition may be taken in liquid state by the brush.

The brush may be loaded with composition by being immersed in a container containing the composition, the container being provided with a wiper member for wiping the brush.

The composition may be heated by the brush while the brush is immersed in the container, and before the composition is taken, or, in a variant, it may be heated by the brush after it has been taken by the brush.

The applicator may include a switch optionally enabling the user to start heating. Heating may also be started automatically while separating the applicator from the container, e.g. while beginning to unscrew the applicator from the container. This makes it possible to start heating the brush before it passes through the wiper member, which may make the composition more fluid on passing through the wiper member, and may improve the quality of distribution of the composition over the brush.

The applicator may include a light source that is visible on its outside surface, e.g. constituting a visual indicator enabling the user to know when heating has been started.

All known configurations of bristles on a twisted core may be used in the invention.

By way of example, the core of the brush may include 3 to 50 turns carrying bristles.

The brush may include 5 to 80 bristles per turn, or even 15 to 40 bristles per turn, in particular 10 to 50. The number of bristles per turn corresponds to the number of bristle ends counted by a stationary observer, while the brush turns through 180° about its core.

By way of example, the length of the portion of the core carrying the bristles may lie in the range 5 millimeters (mm) to 35 mm.

By way of example, the length of the bristles measured from the core to their free end may lie in the range 0.1 mm to 10 mm. The core of the brush may optionally be central, and the bristles of the brush may be subjected to machining while they are in place on the core.

The applicator may include a vibration source, e.g. a disk motor that drives an off-center fly-weight in rotation.

The invention can be better understood on reading the following description of non-limiting embodiments thereof, and on examining the accompanying drawings, in which:

FIG. 1 shows an embodiment of a device 1 for applying a cosmetic composition to macroscopic human keratinous fibers and/or for combing said fibers, in particular for applying mascara to the eyelashes.

Figure 1:
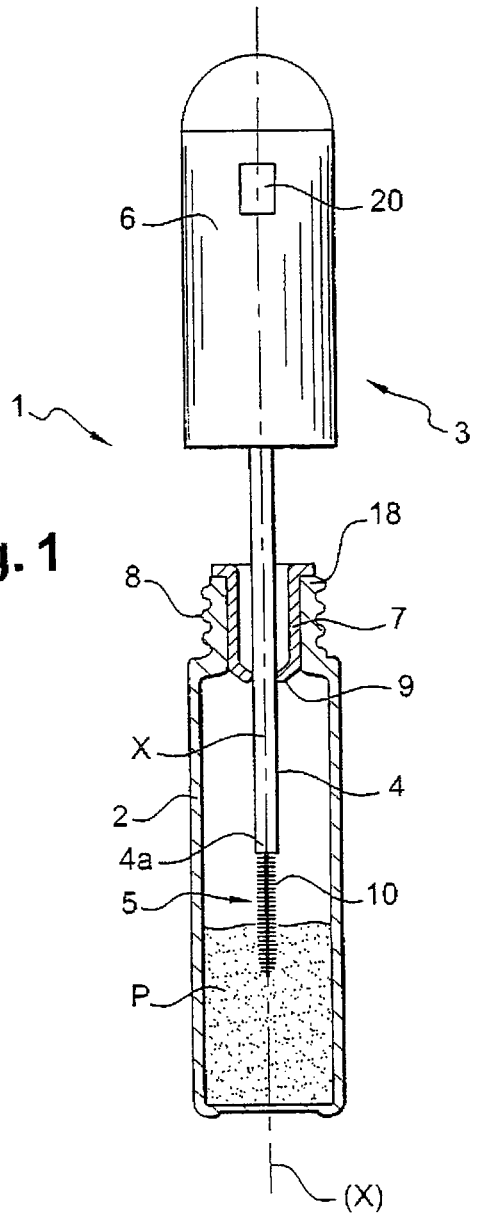
FIG. 1 is a fragmentary and diagrammatic longitudinal section showing a first embodiment of a device of the invention.

As shown, the device 1 includes a container 2 containing the cosmetic composition P for application. By way of example, the formulation of the composition is adapted to a hot application, the composition including ingredients that react to a source of heat.

The device 1 includes an applicator 3 comprising a stem 4, e.g. of cross-section that is circular, that is provided at its distal end 4*a* with a brush 5 and that is connected at its proximal end to a handle 6 that also constitutes a closure cap for closing the container 2.

As can be seen in FIG. 1, the container 2 may include a wiper 7, e.g. constituted by a part that is made of elastomer and that is inserted in the neck 8 of the container. The wiper may optionally be conventional, or it may even be adjustable.

In the embodiment described, the stem 4 presents a longitudinal axis X that is rectilinear, and that coincides with the longitudinal axis of the container 2 when the applicator is fastened thereon.

As shown, the neck 8 may include an outside thread 18 for co-operating with an inside thread 19 of the handle 6 for fastening the applicator 3 on the container 2.

By way of example, the handle 6 is configured to close the container 2 in leaktight manner once it has been screwed home on the neck 8.

In the embodiment shown, the wiper 7 includes a wiper orifice 9 of section that is circular, having a diameter that corresponds substantially to the diameter of the stem 4.

The applicator 3 is described below in greater detail with reference to FIG. 2.

The brush 5 comprises a core 10 that is formed of at least two branches 11 and 12 of a resistor wire, which branches are twisted together, and of bristles 13 that are carried by the core.

By way of example, the resistor wire is made out of: a non-magnetic nickel and chromium alloy, also known as Nichrome®; a copper and nickel alloy, also known as Constantan®; or an iron-nickel-aluminum or iron-chromium-aluminum alloy. By way of example, the resistivity of the wire is 0.225 ohms per centimeter ($\Omega cm^{-1}$).

The surface of the resistor wire of the core 10 may optionally be covered in electrical insulation. The surface may be electrically insulated by oxidizing or by enameling the wire.

By way of example, the diameter of the resistor wire lies in the range 0.1 mm to 2 mm, e.g. the diameter being selected as a function of the operating temperature of the brush, e.g. said operating temperature lying in the range 25° C. to 125° C. The section of the resistor wire may optionally be circular.

Figure 3:
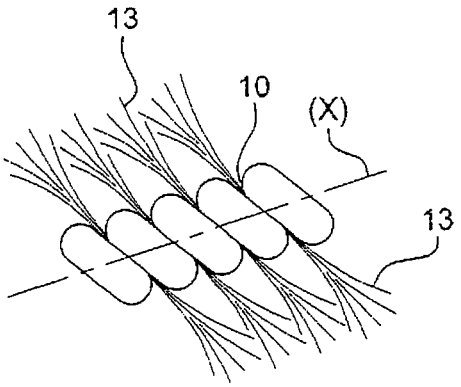
FIG. 3 shows a brush core in embodiments of the invention.

During fabrication of the brush, the bristles 13 are disposed in known manner, e.g. as described in application EP 0 611 170, substantially side by side along the length of the gap defined between the branches 11 and 12 of the not-yet-twisted core 10, and the core 10 is then twisted in such a manner that the bristles 13 are trapped between the branches 11 and 12 of the core, as shown in FIG. 3.

In this embodiment, the bristles are only held by the core by being trapped between the branches 11 and 12, with no additional fastening step required.

In order to form the branches, the resistor wire is folded into a U-shape.

The core 10 may be twisted with a left-hand pitch, as taught in application EP 0 611 170. The core may also be made by twisting together two branches that belong to two distinct wires respectively.

The branches may possibly be twisted together after they have been electrically connected to power supply wires.

While the branches are being twisted together, the non-twisted ends may be held apart, so as to make it easier to mount them on the connectors of the stem, and so as to avoid a short-circuit between the branches when the surface of the wire is not insulated.

In another variant not shown, the core may be twisted with a right-hand pitch.

Figure 4:
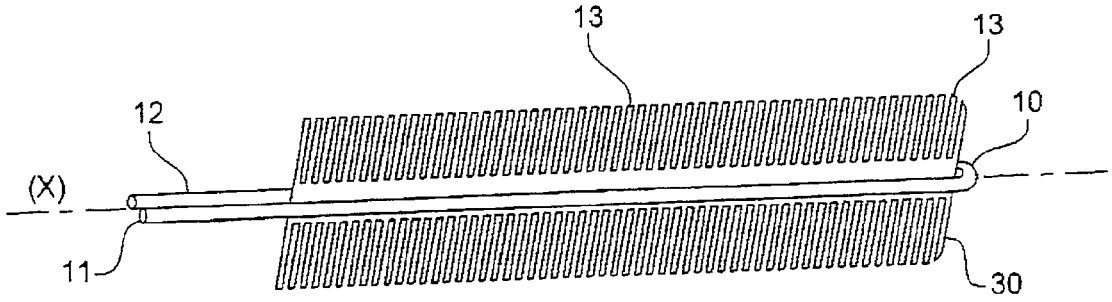
FIGS. 4 and 5 show a brush in an embodiment of the invention.
Figure 5:
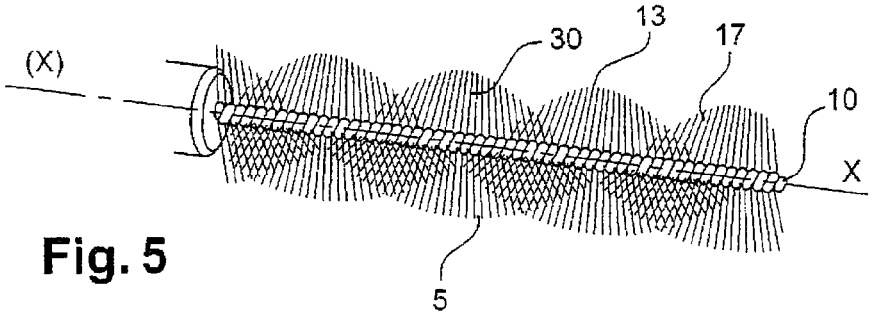

In a variant, and as described in international application WO 2007/125206, the brush 5 is fabricated using a wafer 30, as shown in FIG. 4, carrying bristles 13 that are made integrally with the wafer 30 or that are fitted thereto. By way of example, the wafer 30 is inserted into the gap defined between the two branches 11 and 12 of the not-yet-twisted core. The core 10 may then be twisted, thereby causing the wafer 30 to be held between the branches 11 and 12, as shown in FIG. 5.

The bristles are then only held by being trapped between the branches 11 and 12, with no additional fastening step.

Figure 6:
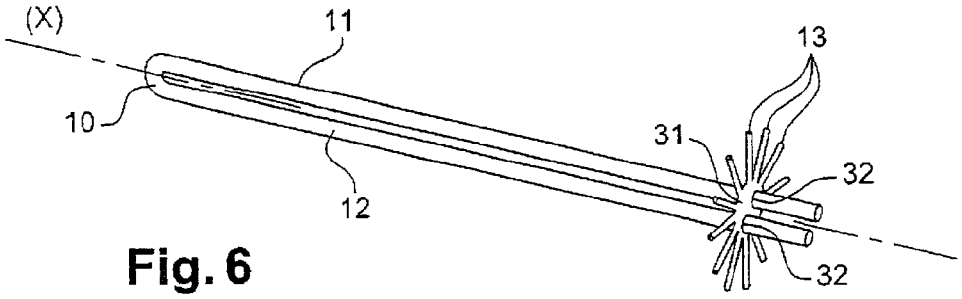
FIGS. 6 and 7 show a brush in another embodiment of the invention.

In another variant, shown in FIG. 6, and as described in international application WO 2007/125207, the brush includes a plurality of elements 31 that are slid onto the not-yet-twisted core 10 via holes 32 that are formed in each element. Each element carries bristles 13 that project from its periphery.

Figure 7:
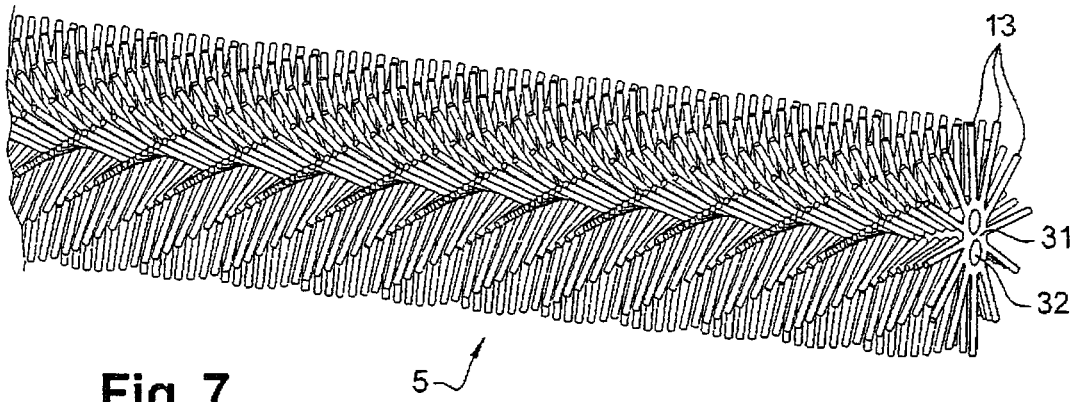

By way of example, the bristles 13 of the elements disposed along the core 10 are aligned axially before the core 10 is twisted. When the core 10 is twisted, the bristles of the elements become offset relative to one another, in such a manner as to form a helical layer of bristles, as shown in FIG. 7.

Figure 10:
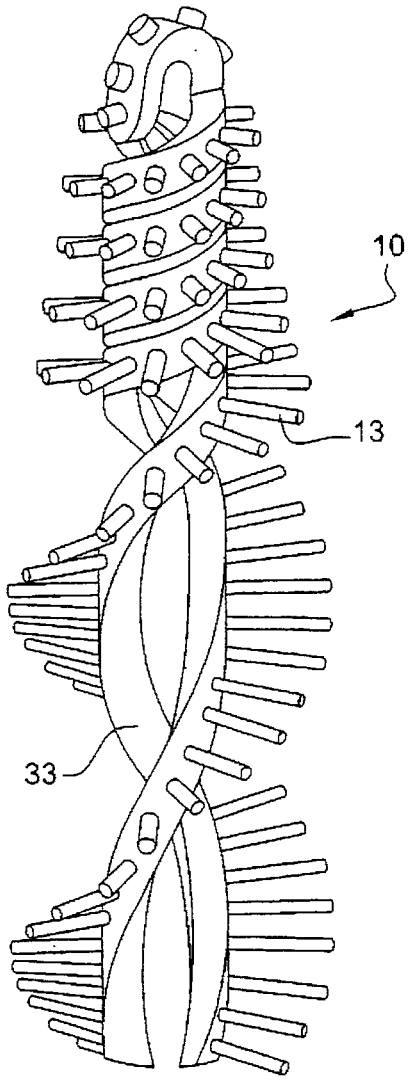
FIGS. 8 to 10 show a brush in another embodiment of the invention, FIG. 9 being a section view on IX-IX of FIG. 8.
Figure 8:
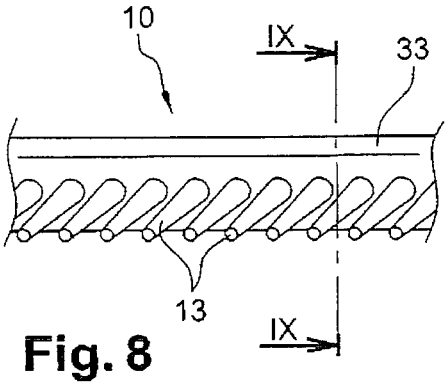
Figure 9:
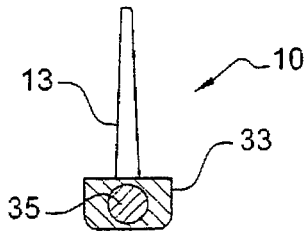

A brush in another embodiment of the invention is described below with reference to FIGS. 8 to 10. As can be seen in FIGS. 8 and 9, the core 10 may include a sheath 33 that is made out of thermoplastic material and that is molded integrally with bristles 13 around the resistor wire 35, similarly to that described in US application No. 2008/0083421. The resistor wire 35 sheathed in this way may thus be folded into a U-shape, then the branches twisted together, as shown in FIG. 10. The sheath 33 may provide electrical insulation for the resistor wire.

In the embodiments shown in FIGS. 1 to 10, the core 10 is rectilinear, but the invention is not limited to such a configuration. In variants not shown, the core is not rectilinear, e.g. it is curved.

The core 10 may include at least one bent portion that may carry bristles, or that may be situated between the bristles and the stem.

The distal end of the brush 5 may optionally be offset relative to the longitudinal axis X of the applicator 3, as described in application EP 1 836 924, for example.

In an embodiment that is not shown, the core is twisted with a left-hand pitch over a fraction of its length, then with a right-hand pitch over the remainder of its length.

The bristles 13 may be natural or synthetic, and may, for example, be fabricated out of: polyolefin, e.g. polyethylene; polyamide, in particular PA6, PA6/10, PA6/12; or even thermoplastic polyester elastomer, e.g. sold under the trade name Hytrel®; polyether block amide, e.g. sold under the trade name Pebax®; silicone rubber; or polyurethane; this list not being limiting.

The bristles 13 may be made out of a thermoplastic material, e.g. polyamide, filled with carbon or with metal particles, e.g. copper.

The bristles 13 may be made out of a material that changes color as a function of temperature.

The brush 5 may include a mixture of bristles made out of different materials.

By way of example, the bristle diameter lies in the range 0.01 mm to 2 mm.

Figure 2:
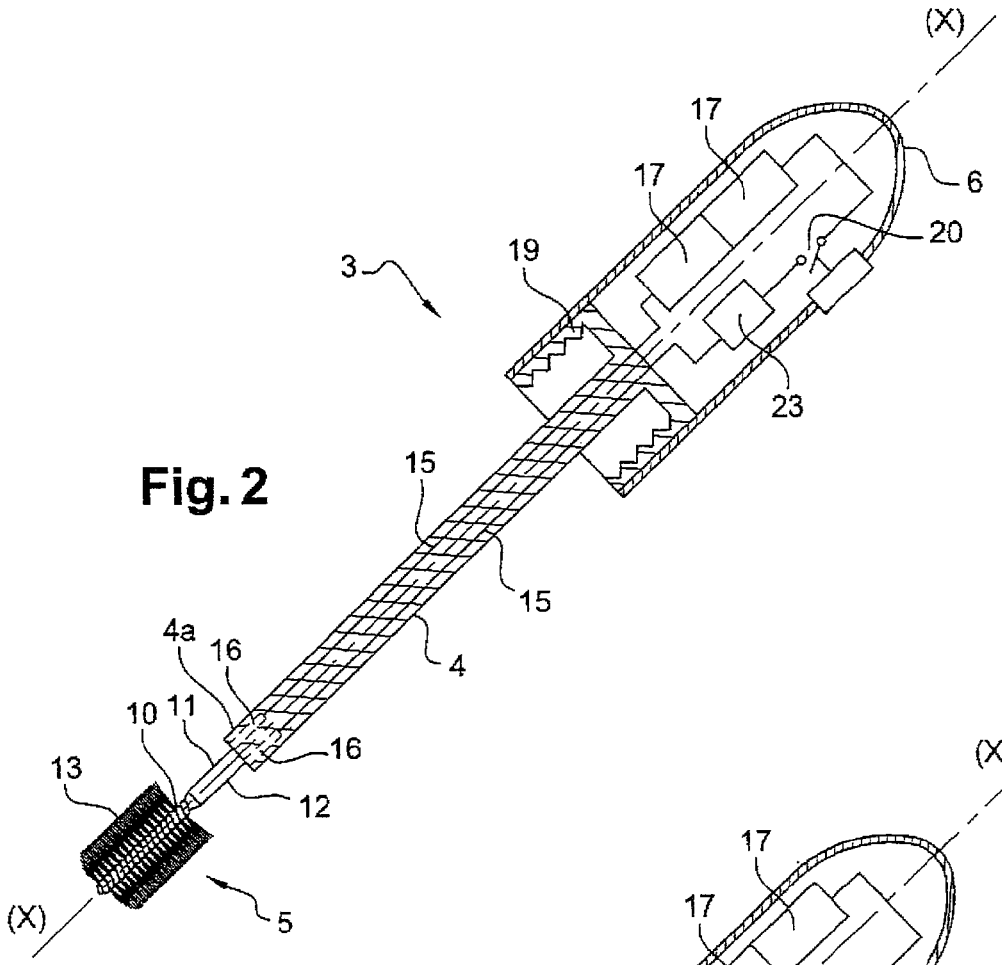
FIG. 2 shows an example of an applicator.

As shown in FIG. 2, two electrical conductors 15 may extend inside the stem 4.

In the embodiment described, at its distal end 4*a*, the stem 4 includes electrical connectors 16 for receiving the free ends of the branches 11 and 12 of the core 10. By way of example, the stem 4 is overmolded on the connectors 16. By way of example, the branches 11 and 12 are force-fitted in the connectors 16. The friction exerted during mounting may eliminate the surface insulation of the wire locally. The connectors 16 may also be crimped or soldered on the branches. The branches may be fastened to the connectors before the thermoplastic material of the stem is overmolded on said connectors.

The applicator 3 may include a power supply 17 that is connected to the branches 11 and 12 of the core 10 in such a manner that the core gives off heat while an electric current is passing therethrough. By way of example, the power supply 17 comprises an independent electrical energy source, in particular one or more rechargeable batteries.

In the embodiment described, the power supply 17 is housed in the handle 6.

The applicator 3 may include an electrical switch 20 that makes it possible to power the resistor wire of the core 10 selectively from the power supply 17, via the electrical conductors 15.

By way of example, and as shown in FIG. 2, the switch 20 is actuated by a button that projects from the outside surface of the handle 6, and on which a user may press.

Figure 11:
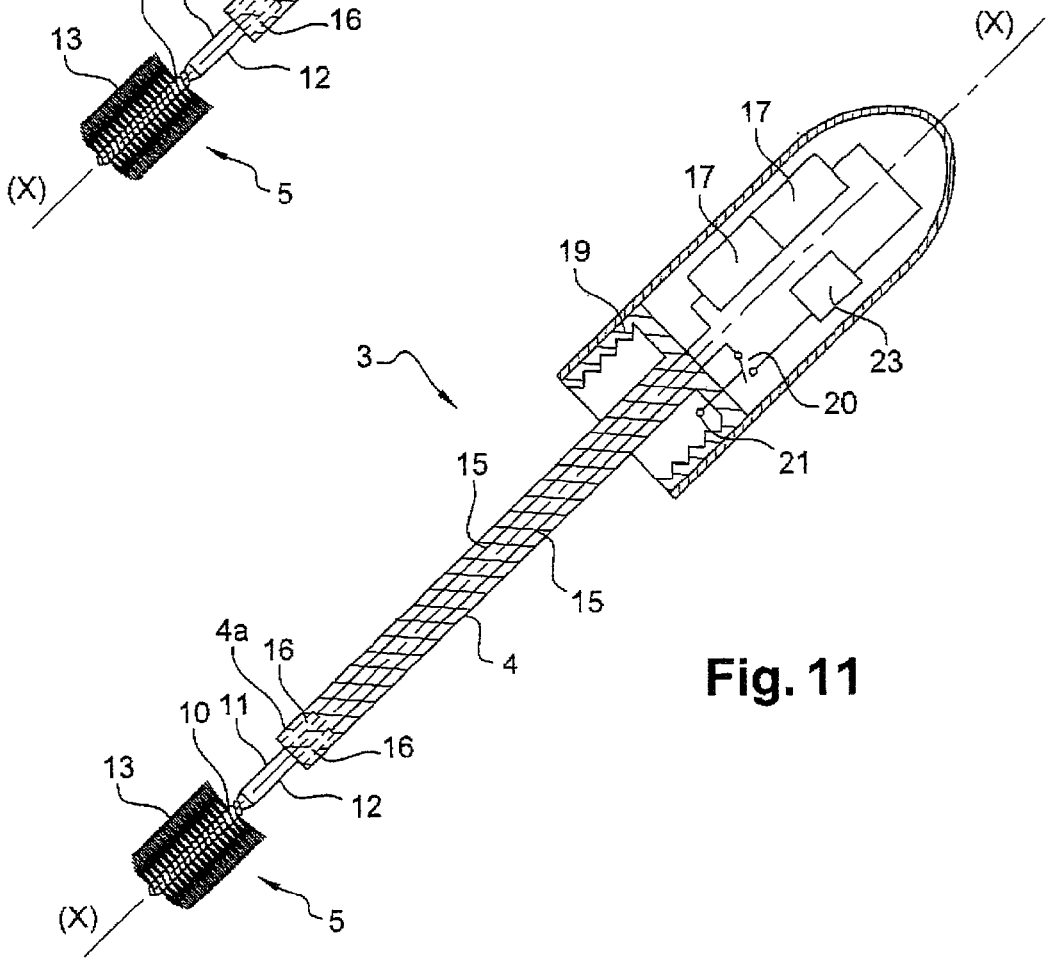
FIG. 11 shows a variant of the FIG. 2 applicator.

In the variant in FIG. 11, the switch 20 is open or closed as a function of the movement along the axis X of a switch 21, depending on whether or not the handle 6 is fastened on the container 2, in such a manner that the core 10 of the brush 5 is automatically powered electrically while the applicator 3 is being separated from the container 2.

As shown in FIGS. 2 and 11, the applicator 3 may include a regulator system 23 for regulating the temperature of the core 10, the regulator system 23 being housed in the handle 6, for example. The regulator system 23 may time or chop the current delivered to the resistor wire.

The resistor wire may also be powered with DC directly from the battery(ies), the resistivity of the wire being selected so that it does not draw too high a current, while nevertheless reaching the desired temperature. By way of example, two 1.5 volt (V) batteries may be used that are electrically connected in series so as to power a resistor wire having a total length of 16 centimeters (cm), and preferably having a diameter that is equal to 0.5 mm, in order to have a current of 400 milliamps (mA) and a temperature of about 60° C.

The invention is not limited to the embodiments described above.

The envelope surface defined by the free ends of the bristles 13 of the brush 5 may define at least one edge, notch, longitudinal or annular groove, or substantially plane facet that is optionally parallel to the axis X of the applicator, as described in application EP 1 836 924. By way of example, the final envelope surface is obtained by machining a brush blank having a cylindrical envelope surface of revolution.

The envelope surface may present a general shape of a ball, and at least a fraction of the envelope surface, better all of said envelope surface, may be substantially spherical to within 20%, as disclosed in application EP 1 977 662.

The brush may be relatively short, as described in application EP 1 649 777, and the bristles may extend over a distance measured along the core 10 that lies in the range 0.1 cm to 1 cm.

A brush of the invention may optionally be used to apply a composition, and, by way of example, may constitute a tool enabling the user to add the finishing touches to makeup applied to macroscopic keratinous fibers, in particular as described in application EP 1 652 449. By way of example, the brush is mounted at the end of a branch of a tool having two branches, the other branch carrying an injection-molded comb, for example.

Figure 12:
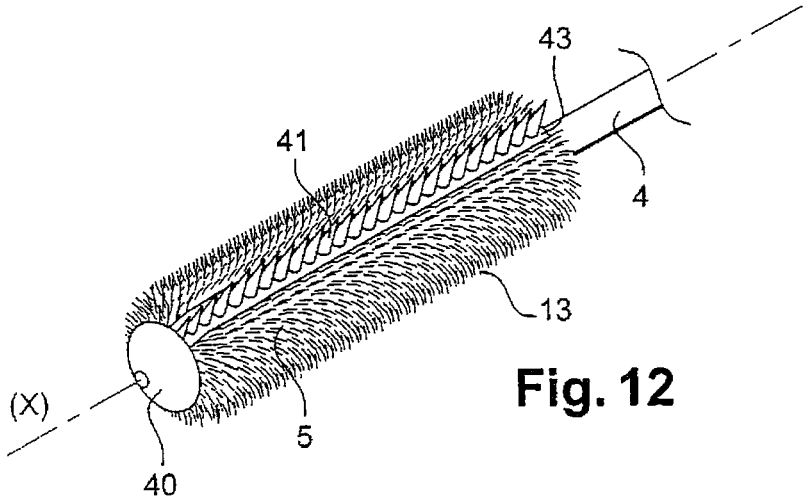
FIG. 12 shows a brush in another embodiment of the invention.

In the embodiment in FIG. 12, the applicator 3 is a hybrid applicator, i.e. it includes an applicator member comprising:

a brush 5 including a twisted core made out of a resistor wire as described above, and carrying bristles 13; and a support 40, made out of thermoplastic material or out of metal, that is secured to the brush 5, and that is used to hold the brush on the applicator, for example.

The support 40 may include power-supply conductors for the core.

The support 40 may carry applicator elements 41 that are molded integrally therewith.

By way of example, the support 40 may comprise branches 43 that are connected together at their proximal and distal ends and that carry teeth 41, and the core of the brush 5 may extend between the branches 43. By way of example, hybrid applicators are described in publication FR 2 916 328.

Figure 13:
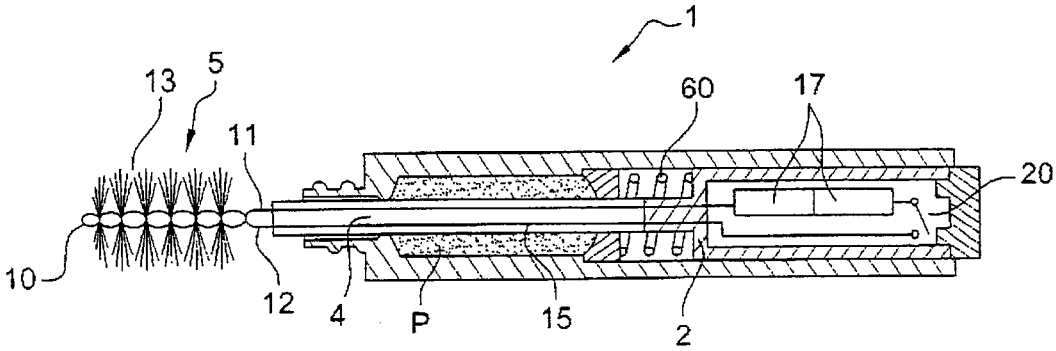
FIG. 13 shows a device in another embodiment of the invention.

In the embodiment in FIG. 13, the stem 4 may move against the action of a spring 60 between a storage position in which the applicator 3 is disposed entirely inside the container 2 and a working position in which the brush 5 projects, at least in part, from the container 2, the container acting as a handle.

The invention is not limited to the embodiments shown. By way of example, the applicator may not only deliver heat, but may also deliver vibration or rotation.

The expression "comprising a" should be understood as being synonymous with "comprising at least one" unless specified to the contrary.

The invention claimed is:

1. A device comprising an applicator including a brush, said brush comprising:

a core that is formed of at least two branches of a resistor wire that are twisted together;

bristles that are carried by the core; and a power supply that is connected to the branches in such a manner that the core gives off heat while an electric current is passing therethrough.

2. A device according to claim 1, the power supply comprising an independent electrical energy source.

3. A device according to claim 1, including a stem that is connected at a first end to the twisted core, and two electrical conductors that pass through the stem and that are respectively connected to the two branches of the core.

4. A device according to claim 3, including two electrical connectors configured to be connected to the core of the brush.

5. A device according to claim 4, the stem being overmolded on the electrical connectors.

6. A device according to claim 1, the surface of the resistor wire being electrical insulation.

7. A device according to claim 1, the surface of the resistor wire not being electrical insulation.

8. A device according to claim 1, the core being twisted with a left-hand pitch.

9. A device according to claim 1, the resistor wire being selected from wires made out of: non-magnetic nickel and chromium alloy; copper and nickel alloy; or iron-nickel-aluminum or iron-chromium-aluminum alloy.

10. A device according claim 1, including a container containing a cosmetic composition for application, and the applicator being configured so as to be fastened on the container.

11. A device according to claim 1, at least one bristle being made out of a material that changes color with temperature.

12. A device according to claim 2, the applicator including a handle, and the independent electrical energy source being housed in the handle.

13. A device according to claim 1, the operating temperature of the brush lying in the range 25° C. to 125° C.

14. A device according to claim 1, the brush being loaded with composition by being immersed in a container containing the composition, the container being provided with a wiper member for wiping the brush.

15. A device according to claim 1, the applicator including a switch optionally enabling the user to start heating.

* * * * *